US006769358B2

(12) United States Patent
Jordan

(10) Patent No.: US 6,769,358 B2
(45) Date of Patent: Aug. 3, 2004

(54) METHOD FOR MANUFACTURING AN ARTICLE OF CLOTHING

(75) Inventor: Manfred Jordan, Lindenberg (DE)

(73) Assignee: Mayser GmbH & Co. KG, Lindenberg (DE)

( * ) Notice: Subject to any disclaimer, the term of this patent is extended or adjusted under 35 U.S.C. 154(b) by 0 days.

(21) Appl. No.: 10/011,126

(22) Filed: Oct. 22, 2001

(65) Prior Publication Data

US 2003/0019373 A1 Jan. 30, 2003

(30) Foreign Application Priority Data

Jul. 11, 2001 (DE) ..... 101 33 644

(51) Int. Cl.[7] ..... A41C 3/12; B41M 1/26

(52) U.S. Cl. ..... 101/129; 427/285; 427/282; 450/92; 450/93

(58) Field of Search ..... 101/114, 129; 450/1, 43, 53, 92, 93; 2/67; 427/285, 288, 282, 355, 370, 284

(56) References Cited

U.S. PATENT DOCUMENTS 4,701,964 A 10/1987 Bell et al. ..... 2/406
5,820,443 A 10/1998 Burr ..... 450/40
6,000,994 A * 12/1999 Salotto ..... 450/92

FOREIGN PATENT DOCUMENTS

| | | | |
|---|---|---|---|
| DE | 199 42 996 | | 3/2001 |
| EP | 0 630 630 | A2 * | 12/1994 |
| FR | 2 222 865 | * | 11/1974 |
| FR | 2 808 972 | A1 * | 11/2001 |
| GB | 2 316 353 | | 2/1998 |

* cited by examiner

*Primary Examiner*—Leslie J. Evanisko
(74) *Attorney, Agent, or Firm*—Baker & Daniels

(57) ABSTRACT

A method is described for manufacturing an item of underwear or an item of sportswear by applying a medium, running in lengths and strengthening the fabric of the item of clothing, on to a cut-out piece of material, wherein application of the medium is done by the silk screen printing method or the adhesive coating method and in a first step of the method the printed length is structured in such a way that it substantially corresponds to the later outer contour of the item of clothing and in a second step of the method the printed fabric is cut in the area of the printed length.

2 Claims, 7 Drawing Sheets

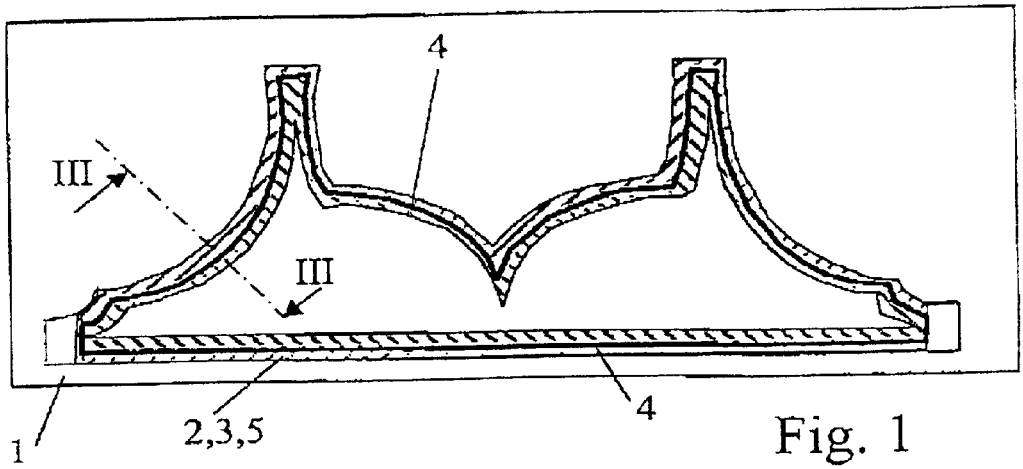
Fig. 1
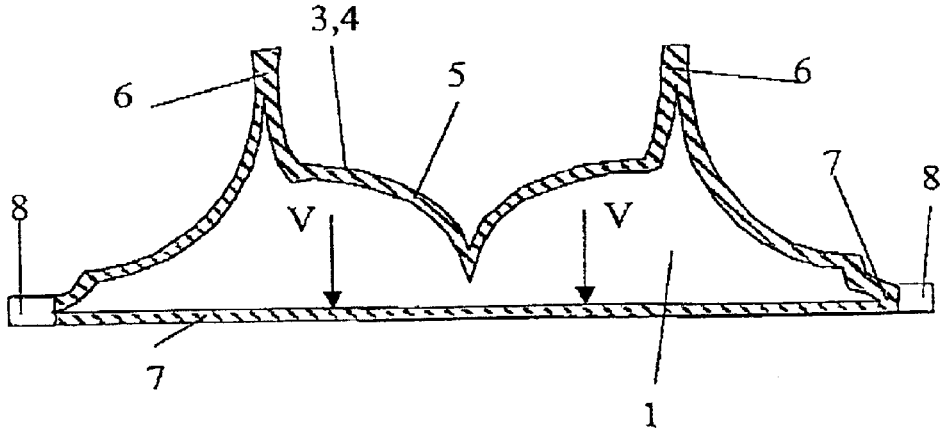
Fig. 2
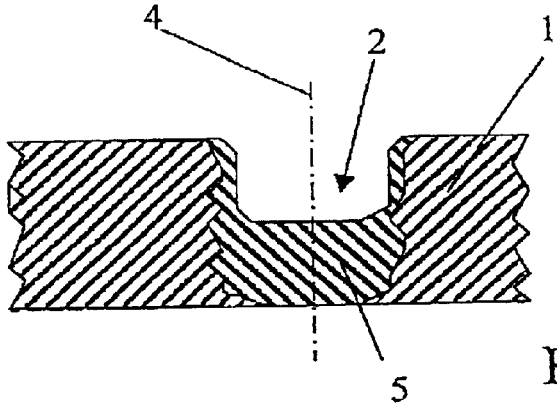
Fig, 3

METHOD FOR MANUFACTURING AN ARTICLE OF CLOTHING

BACKGROUND OF THE INVENTION

1. Field of the Invention

The invention relates to a method of manufacturing an item of underwear or sportswear as well as for manufacturing an item of swimwear.

The previously mentioned items of clothing are for the sake of simplicity hereinafter generally designated as "items of clothing", without any reference to a special purpose of application. The invention therefore takes in all types of application and possibilities for the items of clothing initially mentioned.

For the sake of simplicity in the following description the manufacture of an item of underwear in the form of a brassiere is described in greater detail. The invention is, however, not restricted to this, as has been explained above. The description is therefore to be understood only as an example.

2. Description of the Related Art

To reinforce the fabric of items of clothing it has become known with U.S. Pat. No. 4,701,964, to define striped areas on a pair of ladies' briefs by silk screen printing of an adhesive applied in powder form. The adhesive is melted by heat and is introduced into the textile fabric by appropriate heat treatment. An appropriate textile strip is then applied to these striped areas and fixed by gluing. There is therefore a doubling of textile strips on an item of clothing with the aim of creating fabric-reinforced areas.

However, the disadvantage is that a relatively large outlay is necessary, because striped adhesive areas first have to be applied in a silk screen printing process, the bonding agent, which melts when heated, then penetrates into the textile material with appropriate heat treatment and then subsequently the textile strips are stuck on. These fabric-reinforced areas thereby obtain a certain undesired thickness, which can then sometimes show under tight clothing and otherwise offers poor wearing comfort.

With DE 199 42 996 A1 a one-sided application of adhesive takes place on to a single-layer textile carrier material, which, though, is coated with a flock material. The coating with a flock material has the disadvantage, however, that an additional operational outlay is necessary and the applied flock material during the time worn or during washing of the item of clothing becomes worn or shabby in an undesired way.

The coats of adhesive mentioned are otherwise applied by the injection method. This, however, has the disadvantage that the adhesive coat is relatively thick, shows in an unfavourable way on the item of clothing and only minimal wearing comfort is achieved.

With the subject of GB 2 316 353 A1 a further method of manufacturing an item of underwear has become known, in which by means of a slit-shaped mask an application of adhesive takes place on to a fabric, on to which a further layer of a textile is then glued. The same applies to EP 0 809 945 B1, because in the item of ladies' underwear shown there fabric reinforcement takes place on a single-layer textile by means of a gluing method only by doubling further layers of fabric. However, the doubling of layers of fabric is expensive and increases the thickness of the manufactured item of underwear in an undesired way.

Therefore the object of the invention is to further develop a method for manufacturing an item of clothing of the type initially mentioned in such a way that in a simple and economical way fabric-reinforcing areas can be achieved without these areas substantially thickening.

To achieve the object set the invention is characterised by a method according to the technical doctrine described below.

An item of clothing manufactured by this method is described below.

SUMMARY OF THE INVENTION

The invention proposes to apply a fabric-reinforcing adhesive coat to a single-layer textile fabric in such a way that the length of adhesive applied by the printing method or by the adhesive coating method is structured in such a way that it substantially corresponds to the later outer contour of the item of clothing.

In this way a completely novel method for manufacturing items of clothing of this kind is proposed, for it is in this way possible to create a hem-free edge for the item of clothing. The edge itself is formed by the adhesive length according to the invention, which is applied either by the printing method or by the adhesive coating method.

Therefore a smooth, single-layer fabric is coated with a coat of adhesive which substantially corresponds, e.g. to the later outer contour of a brassiere. In a further operational process the fabric coated in this way is cut exactly in the area of this length applied by the adhesive method so the cut edge is exactly in the area of the printed length.

This results in a fabric-strengthened outer area of the item of clothing, reinforced by the adhesive coat. The cut edge no longer has to be hemmed or folded round. There is also no need to manufacture seams, hems or similar by sewing machine. This gives rise to the advantage that the edge of this item of clothing no longer shows even under tight clothing, but in spite of this a highly stable edge area of the item of clothing is created. An item of clothing of this kind is therefore eminently suitable as an item of underwear, an item of sportswear or item of swimwear.

Manufacture is particularly simple, because only one application of adhesive in the area of the later outer contour of the item of clothing takes place and the item of clothing is later cut out exactly in the area of this adhesive application.

Naturally further fabric-reinforced areas can be provided with the said adhesive coat, in order to create even more reinforced areas, constructed as even more stable compared with the basic fabric.

It is herein preferred if the adhesive coat preferably consists in the silk screen printing method as a watery solution consisting of air-drying adhesives.

One or more component adhesives can be used herein. In another configuration of the invention it is provided that instead of application of the printed length by the silk screen printing method an adhesive coating method takes place. In this case a melting bonding agent is applied to a sintered foil in the form of a band. The sintered foil is applied to the item of clothing and printed on by means of heat and pressure, so the heat-melting adhesive located on the sintered band penetrates into the textile fabric and forms a single-layer adhesive area, fabric-reinforced in each case. With this printing method too for the sake of simplicity a "printed length" is referred to. The term "printed length" is therefore adopted for both the silk screen printing method according to the invention and for the previously described transfer print.

With the given printing method it is therefore possible also to use a print medium which foams on hardening and has bubble-shaped air inclusions. This results in a padded, fabric-reinforced area, because the air inclusions in the print medium pad out the fabric in the way of a foam material. If a colour of the print medium is chosen which is different from the colour of the cut-out material interesting aesthetic effects emerge.

The print medium can also consist of an open-cell elastic foam.

In the preceding description it was cited that the outer contour of the item of clothing is preferably provided by the fabric-reinforcing printing method. However, the invention is not restricted to this. It can also be provided to provide only certain areas on the textile item of clothing with the fabric-reinforcing adhesive coats, without these adhesive coats necessarily being in the area of the outer contour.

The invention therefore takes in all possibilities of creating certain areas in an item of clothing of the kind initially mentioned by fabric-reinforcing adhesive application. In the case of manufacturing a brassiere the arrangement of the different printed areas is, however, preferred in such a way that at least the band below the breast, the band above the breast and the back band are made by fabric-reinforcing application on a single-layer textile item.

In a further development of the invention additional fabric-reinforcing adhesive coats can also be provided in the inner area of the brassiere.

In particular an additional design print can be used in the inner area of the brassiere, e.g. in the area of the cups.

Additional printed areas can be arranged in particular in the area of the half-cups to achieve a lifting effect.

In the same way the wires in the brassiere formerly made of plastics material or wire can now be effected according to the invention by a rod-shaped application of a fabric-reinforcing medium. The wire previously constructed as a plastics material or wire hoop is now replaced by an approximately semi-circular, rod-shaped adhesive coat which at least partially surrounds the half-cups from underneath.

The subject of the present invention emerges not only from the subject of the individual patent claims but also from the combination of the individual patent claims with one another.

All details and features disclosed in the documents, including the abstract, in particular the three-dimensional configuration illustrated in the drawings, are claimed as essential to the invention, in so far as they are individually or in combination novel compared with the prior art.

BRIEF DESCRIPTION OF THE DRAWINGS

The invention is explained in greater detail below using drawings illustrating several embodiments. Further features and advantages of the invention essential to the invention emerge from the drawings and their description.

FIG. 1 shows a horizontal projection on to a single-layer textile with printed on outlines of a brassiere.

FIG. 2 shows the brassiere according to FIG. 1, after cutting.

FIG. 3 shows a section according to line III—III in FIG. 1.

DETAILED DESCRIPTION

Figure 4:
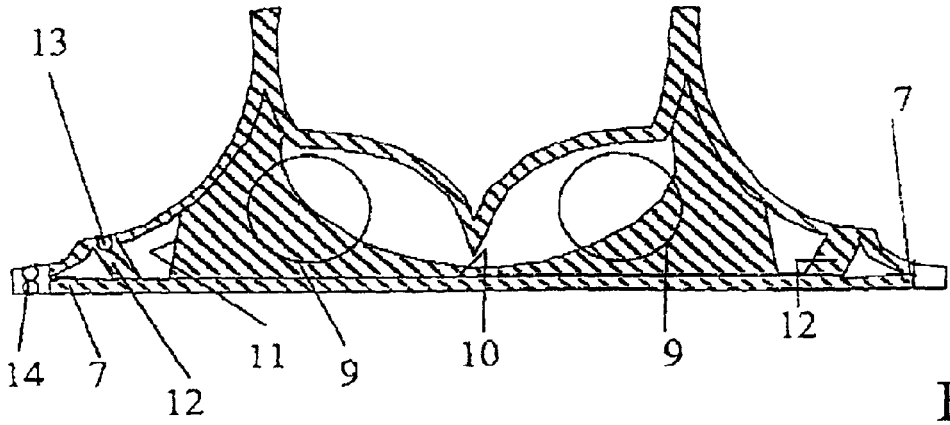
FIG. 4 shows a further development of the brassiere in FIG. 2 with arrangement of further fabric-reinforced areas.

In FIG. 1 an outline in the form of a printed length 2 is printed on an approximately rectangular cut-out piece of material 1, wherein this printed length has been applied either by the silk screen printing method or by transfer print.

The printed length herein forms the outer contour 3 of a brassiere, wherein the printed length 2 is formed from a printed paste 5.

To manufacture the brassiere according to FIG. 2 a cutting line 4 is positioned inside the printed length 2 and the brassiere is cut out accordingly. The entire outer outline of the brassiere therefore consists of half the printed length 2 according to FIG. 1. In particular the straps 6, the back part 7 and other pasts of the brassiere are formed from the printed length. The thereby formed cutting line 4 (cutting edge) no longer needs to be hemmed and is protected against fringing. According to FIG. 3 the printed length 2 in its height can fall short of the height of the remaining cut-out material 1 owing to the fabric-reinforcing and strengthening effect. The outer outline of the brassiere is then even constructed as thinned compared with the remaining surfaces. As illustrated in FIG. 3, the adhesive completely penetrates through the fabric to form a single layer adhesive/fabric area.

This is, however, only one possible embodiment. Naturally it is possible to construct the height of the printed length with the printed paste 5 equally as high as the thickness of the cut-out material 1.

Further parts can otherwise be arranged by the adhesive printing method, in particular also a flap 8 in the area of the back part 7.

FIG. 4 shows that further fabric-reinforcing printed areas 9 can also be positioned in the inside of the brassiere. There it can be seen that in the area of the half-cups an arch-shaped inner contour 10 is created which is kept free of fabric-reinforcing coats. This ensures that the lateral printed areas 9 exert a supporting and lifting effect in the direction of the breastbone of the wearer.

Additional printed areas in the form of reinforcing webs 12 can be arranged in the back part, wherein certain outer contours 11 are also kept free of fabric-reinforced adhesive coats.

Buttonholes 13, 14 can also be arranged in the printed area without these having to be hemmed.

Figure 5:
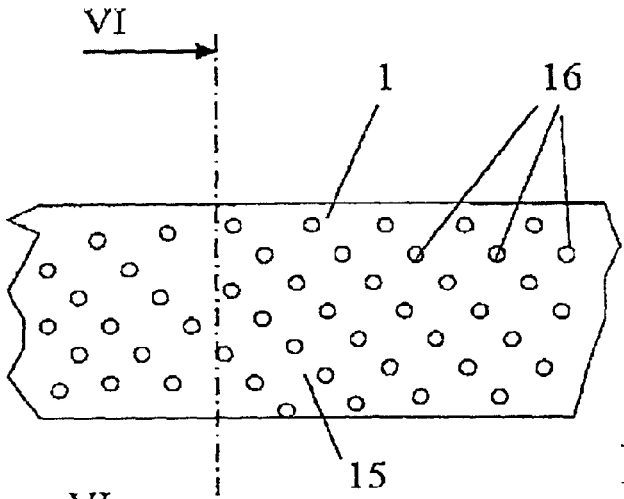
FIG. 5 shows a view according to line V—V in FIG. 2.
Figure 6:
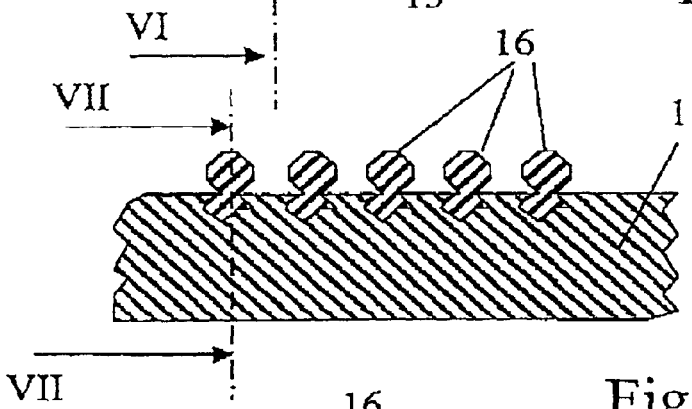
FIG. 6 shows a section according to line VI—VI in FIG. 5.

FIG. 5 shows that the print application can take place not just on the full surface, as taught by FIG. 3, but the adhesive coat can take place in the form of a dotted printed surface 15. With this, printed tufts 16 in the form of adhesive coats are created which have the structure according to FIG. 6.

Figure 7:
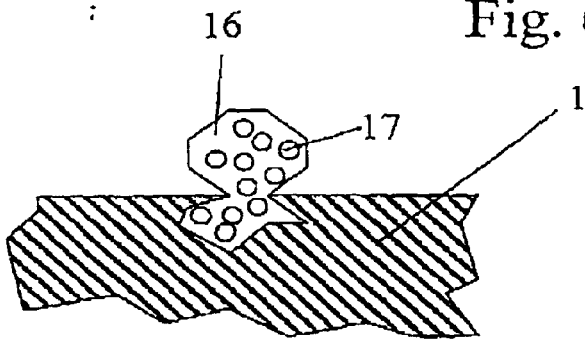
FIG. 7 shows a section according to line VII—VII in FIG. 6.

It can additionally be provided that the print medium has air inclusions (air bubbles) 17, whereby a padded tuft form according to FIG. 7 emerges. A pleasant wearing effect thereby emerges with good padding effect and undesired riding up of the brassiere in the back part is safely avoided because the tufts 16 form a good contact with the human body.

Figure 8:
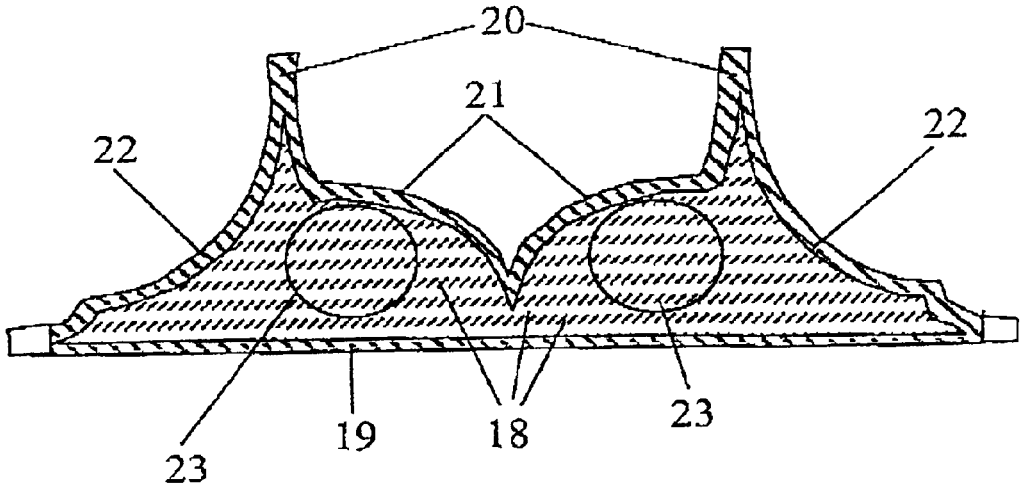
FIG. 8 shows an embodiment modified compared with FIG. 4.

FIG. 8 shows that the entire inside of the brassiere with fabric-reinforcing strips 18 can be formed from an adhesive coat. An additional design print can also be provided.

In particular the band below the breast 19, the strap band 20 and the band above the breast 21, as well as the back band 22 (corresponding to the outer contour 3), can be formed from the previously mentioned printed length 2.

The cup areas 23 are only indicated here.

Figure 9:
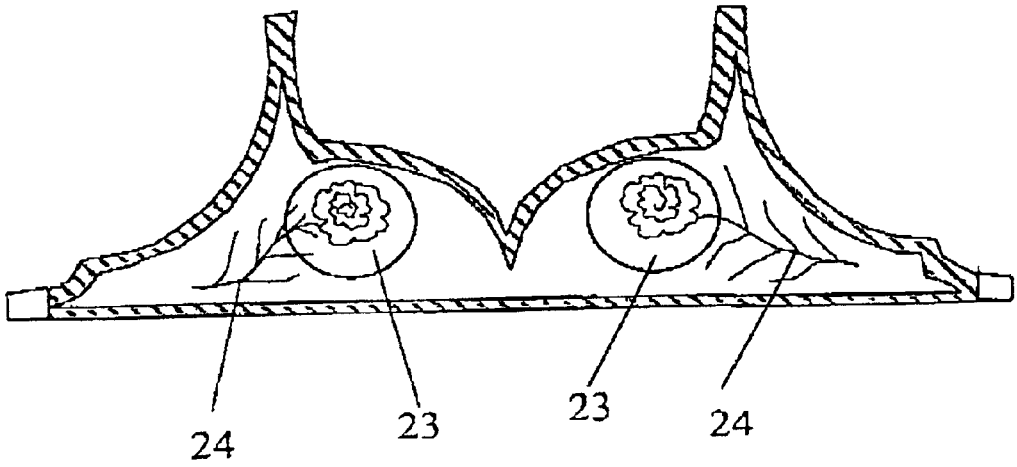
FIG. 9 shows a further modified embodiment.
Figure 10:
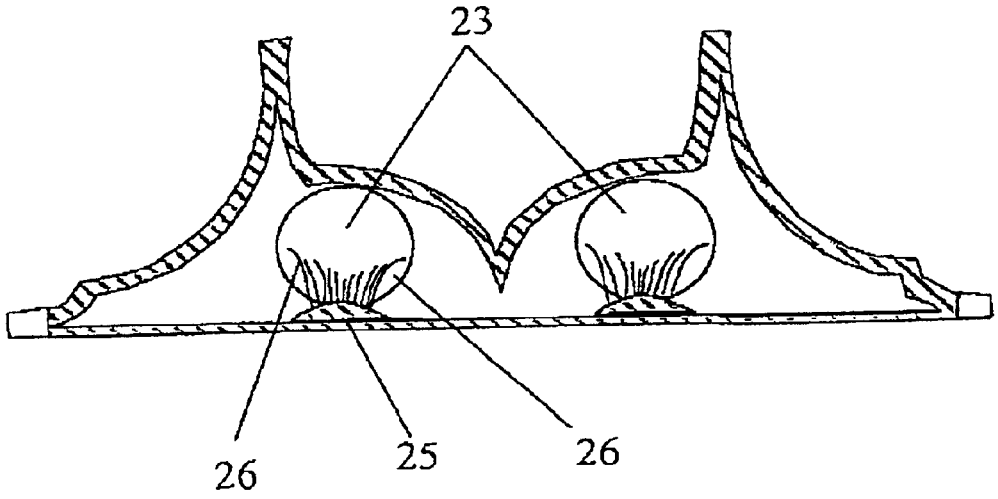
FIG. 10 shows a fourth embodiment.

FIG. 9 shows that an appropriate design print 24 can also be provided in the inside of the brassiere. FIG. 10 shows that an additional support and lifting effect can take place by applying appropriate fabric-reinforced elastic printed lengths. An approximately arch-shaped printed area 25 is herein created from the said adhesive coat underneath the half-cups 23, starting from which striped printed strips 26 extend upwards into the area of the cups 23.

In this way a light brassiere with lifting effect is achieved.

Figure 11:
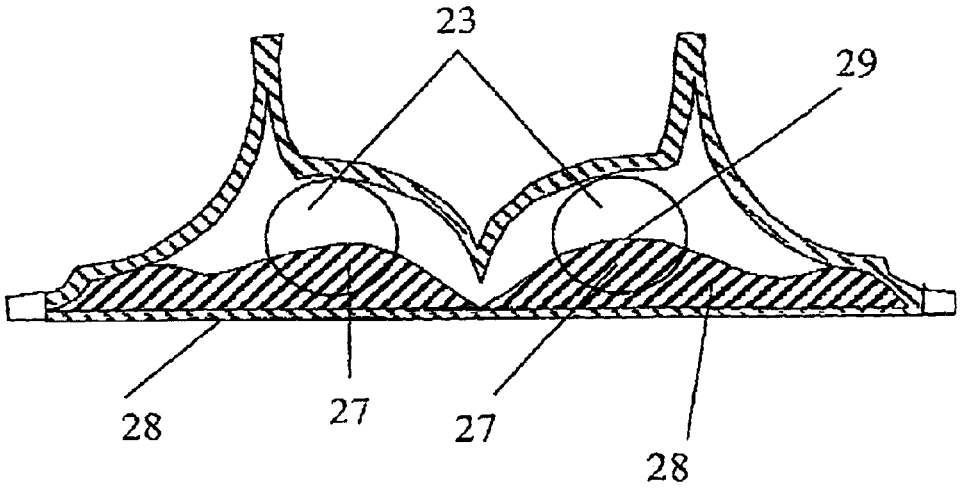
FIG. 11 shows a fifth embodiment.

FIG. 11 shows a brassiere with half-cup reinforcement. In the area of the half-cups 27 appropriate reinforcing areas 28 are provided, which extend over the entire back part and also extend into the cup area 23 in the form of an arch-shaped contour 29.

Figure 12:
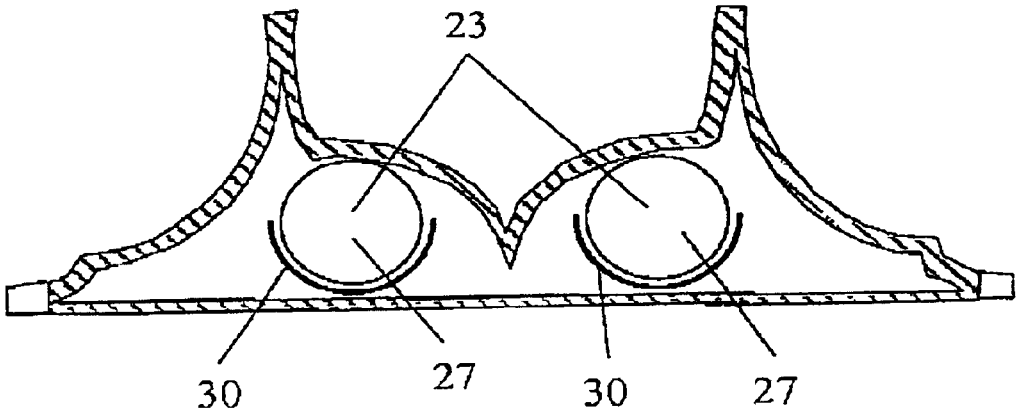
FIG. 12 shows a sixth embodiment.

FIG. 12 shows that as a substitute for the conventional plastics material or metal wires, which grip the half-cups 27 underneath, rod-shaped areas 30 can also be applied by the printing method, which replace the conventional wires.

It is therefore important in the invention that only one printed coat in the form of an elastic medium reinforcing the fabric takes place on a single-layer textile fabric with relatively low manufacturing costs.

What is claimed is:

1. A method for manufacturing an article of clothing, comprising the steps of:

providing a piece of fabric material;

applying a strengthening material to an un-hemmed, single layer portion of the fabric material by one of a silk screen printing method and an adhesive coating method to create a reinforced fabric area corresponding substantially to the perimeter of an article of clothing, the strengthening material caused to penetrate completely through the fabric material to both sides thereof; and cutting along a cut line within the reinforced fabric area such that the strengthening material remains on both sides of the cut line to provide an article of clothing from the fabric material, the article of clothing having at least a portion of the reinforced fabric area around the perimeter thereof and within the perimeter thereof.

2. The method of claim 1 wherein said reinforced fabric area is thinner than the fabric adjacent said reinforced fabric area.

* * * * *